US008476817B2

(12) United States Patent
Miyashita et al.

(10) Patent No.: US 8,476,817 B2
(45) Date of Patent: Jul. 2, 2013

(54) SPARK PLUG

(75) Inventors: Naomichi Miyashita, Kasugai (JP); Mamoru Musasa, Hurricane, WV (US); Akira Suzuki, Nagoya (JP); Kazuyoshi Torii, Chita-gun (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/146,816

(22) PCT Filed: Jan. 27, 2010

(86) PCT No.: PCT/JP2010/000447
§ 371 (c)(1),
(2), (4) Date: Jul. 28, 2011

(87) PCT Pub. No.: WO2010/087158
PCT Pub. Date: Aug. 5, 2010

(65) Prior Publication Data

US 2011/0294369 A1 Dec. 1, 2011

(30) Foreign Application Priority Data

Jan. 29, 2009 (JP) ..... 2009-018643

(51) Int. Cl.
*H01T 13/20* (2006.01)

(52) U.S. Cl.
USPC ..... 313/141

(58) Field of Classification Search
USPC ..... 313/118–145; 123/32, 41, 143 R, 123/146.5 R, 169 P, 260, 280, 169 R, 169 EL, 123/310; 445/7; 219/121.6, 121.64
See application file for complete search history.

(56) References Cited

U.S. PATENT DOCUMENTS

| | | | | |
|---|---|---|---|---|
| 6,215,235 | B1 * | 4/2001 | Osamura | 313/141 |
| 6,304,022 | B1 | 10/2001 | Matsutani | |
| 7,083,488 | B2 * | 8/2006 | Taniguchi et al. | 445/7 |
| 2002/0121849 | A1 * | 9/2002 | Kanao et al. | 313/141 |
| 2008/0238282 | A1 * | 10/2008 | Kato et al. | 313/142 |

FOREIGN PATENT DOCUMENTS

| | | | |
|---|---|---|---|
| JP | 11-204233 | A | 7/1999 |
| JP | 11-233233 | A | 8/1999 |
| JP | 2005-294272 | A | 10/2005 |
| JP | 2006-173141 | A | 6/2006 |
| JP | 2008-277272 | A | 11/2008 |

OTHER PUBLICATIONS

Lide, David R. (editor), CRC Handbook of Chemistry and Physics, CRC press, 89th edition, pp. 12-201-12-202.*

* cited by examiner

*Primary Examiner* — Donald Raleigh
(74) *Attorney, Agent, or Firm* — Sughrue Mion, PLLC

(57) ABSTRACT

The present invention provides a spark plug which is capable of suppressing a occurrence of crack and separation by determining a structural configuration of a melting portion formed in a junction portion between a discharge portion and a pedestal portion which form an ignition portion that protrudes from a ground electrode. In a profile line shape of a cross section including a center axis P of an ignition portion 80, an exposure surface 88 of a melting portion 83 connects a side surface 82 of a discharge portion 81 and a side surface 85 of a pedestal portion 84. Further, an exterior angle θ formed between an imaginary line Q, which passes through a boundary position X1 between the melting portion 83 and the pedestal portion 84 and a boundary position X2 between the melting portion 83 and the discharge portion 81, and the center axis P at a node C, satisfies 135°≦θ≦175°. Furthermore, a proportion T/S of a forming depth T of the melting portion 83 to an outside diameter S of the discharge portion 81 satisfies T/S≧0.5.

6 Claims, 4 Drawing Sheets

SPARK PLUG

CROSS REFERENCE TO RELATED APPLICATIONS

This application is a National Stage of International Application No. PCT/JP2010/000447, filed on Jan. 27, 2010, which claims priority from Japanese Patent Application No. 2009-018643, filed on Jan. 29, 2009, the contents of all of which are incorporated herein by reference in their entirety.

TECHNICAL FIELD

The present invention relates to a spark plug whose ground electrode is provided with an acicular ignition portion that forms a spark discharge gap with a center electrode.

BACKGROUND ART

In recent years, intensification of environmental pollution control measure against exhaust gas exhausted from an internal combustion engine has been required. Since enhancement of ignitability (ignition performance) contributes to purification of the exhaust gas, a spark plug whose ground electrode is provided with, on an inner surface thereof, an electrode chip (a discharge portion) that is formed using noble metal having high resistance to spark erosion, so as to protrude toward a center electrode, has been developed. In the spark plug having such configuration, in comparison with conventional spark plugs, since the ground electrode can be set away from a spark discharge gap, a flame nucleus (a flame core) formed in the spark discharge gap is less prone to reach the ground electrode at an early stage of its growth process. For this reason, a so-called quenching action, which inhibits the growth of the flame core by that fact that the flame core reaches the ground electrode and heat is absorbed by the ground electrode, is reduced, and thereby improving the ignition performance of the spark plug.

In such spark plug, because a great thermal load is applied to the electrode chip, there is a risk that a crack or separation will appear at a junction portion between the discharge portion and the ground electrode. Thus, for the junction between the discharge portion (an ignition portion) and the ground electrode, a pedestal portion (a projection), as an intermediate member that has an intermediate coefficient of linear expansion between both linear expansion coefficients of the discharge portion and the ground electrode, intervenes between the discharge portion and the ground electrode. With this pedestal portion, thermal stress that could occur in each junction portion of the discharge portion, the pedestal portion and the ground electrode is relaxed, thereby reducing the occurrence of the crack or the separation (for example, see Patent Document 1). Further, in the Patent Document 1, a junction between the electrode chip and the intermediate member is welded not by resistance welding by which an excessive pressure welding force acts on the junction upon the welding but by laser welding which can easily concentrate heat onto the junction and set a melting depth to be deep also reduces a tendency for internal stress to remain after the welding. Then by this laser welding for welding the electrode chip and the intermediate member, a melting portion in which their respective constituent materials (components) are mixed together is formed between the electrode chip and the intermediate member.

CITATION LIST

Patent Document

Patent Document 1: Japanese Patent Provisional Publication Tokkaihei No. JP11-204233

SUMMARY OF THE INVENTION

Technical Problem

However, although each of the discharge portion and the pedestal portion expands when subjected to the thermal load by combustion of the engine then deforms, the melting portion may have a structure that restrains or suppresses the deformation of the discharge portion and the pedestal portion depending on structural configuration, such as a position and a shape, of the melting portion formed between the discharge portion and the pedestal portion. Especially when the melting portion is formed so as to unite a side surface of the discharge portion and a surface of a protrusion top end side of the pedestal portion, the structure of the melting portion is in a state in which the melting portion holds the discharge portion inwards in a radial direction orthogonal to a protruding direction in which the discharge portion protrudes from the ground electrode. The same state occurs at an interface between the melting portion and the pedestal portion. Then when the melting portion restrains or suppresses extension due to the thermal expansion in the radial direction (particularly, outwards) of the discharge portion and the pedestal portion and the internal stress increases at each interface, there is still a risk that the crack or the separation will appear.

The present invention is made for solving the above problem, and an object of the present invention is to provide a spark plug which is capable of suppressing the occurrence of the crack and the separation by determining the structural configuration of the melting portion formed in the junction portion between the discharge portion and the pedestal portion which form the ignition portion that protrudes from the ground electrode.

Solution to Problem

In order to achieve the object, a spark plug of configuration 1 comprises: a center electrode; a ceramic insulator which has an axial hole extending along an axis direction and holds the center electrode inside the axial hole; a metal shell which holds the ceramic insulator and surrounds a circumference of the ceramic insulator; a ground electrode, one end portion of which is fixedly connected with the metal shell, and the other end portion of which curves so that one side surface of the other end portion faces a top end portion of the center electrode; and an ignition portion which is provided at a position that faces the top end portion of the center electrode on the one side surface of the other end portion of the ground electrode and protrudes from the one side surface toward the center electrode, and the ignition portion has the following features. The ignition portion has a pedestal portion which protrudes from the one side surface toward the center electrode; a discharge portion which is joined to a protrusion top end of the pedestal portion by laser welding and forms a spark discharge gap between the discharge portion and the top end portion of the center electrode; and a melting portion which intervenes between the pedestal portion and the discharge portion and is formed with constituent materials of both the pedestal portion and the discharge portion melting and mixed together by the laser welding. Then when viewing an arbitrary cross section of the ignition portion including a center axis of the ignition portion in a direction in which the ignition portion protrudes from the one side surface of the ground electrode, the melting portion is formed so as to extend from a side surface of the ignition portion toward the center axis, and when viewing a profile line of the arbitrary cross section of the ignition portion, the melting portion has a configuration that connects a side surface of the pedestal portion and a side surface of the discharge portion. Further, in the arbitrary cross section of the ignition portion, X1 is located in a boundary position between the pedestal portion and the melting portion at one of the side surfaces of the ignition portion, X2 is located in a boundary position between the discharge portion and the melting portion at one of the side surfaces of the ignition portion, then when viewing a first cross section in which a distance of a straight line connecting the boundary positions X1 and X2 becomes a maximum in the arbitrary cross sections, a relationship between an outside diameter S and an extending length T satisfies $T/S \geqq 0.5$, where S is the outside diameter of the discharge portion in a radial direction orthogonal to the center axis and where T is the extending length of the melting portion in a radially inward direction, on the basis of the boundary position X2 between the discharge portion and the melting portion, and an exterior angle θ formed between an imaginary line that passes through the boundary positions X1 and X2 and the center axis satisfies $135° \leqq \theta \leqq 175°$.

In a spark plug of configuration 2, in more than half of all the arbitrary cross sections of the ignition portion throughout an entire circumference thereof in various directions centering on the center axis, each relationship between the outside diameter S and the extending length T satisfies $T/S \geqq 0.5$, and each exterior angle θ satisfies $135° \leqq \theta \leqq 175°$.

In a spark plug of configuration 3, a difference between a linear expansion coefficient of the constituent material of the discharge portion and a linear expansion coefficient of the constituent material of the pedestal portion is $8.1 \times 10^{-6}$ [1/K] or less.

In a spark plug of configuration 4, the side surface of the pedestal portion and the one side surface of the ground electrode where the pedestal portion is provided are connected through a first connecting portion that has a concave shape curving inwards in a cross section including the center axis of the ignition portion.

In a spark plug of configuration 5, the pedestal portion could has, on one side surface of the ground electrode side, a flange portion formed by enlarging an outside diameter of the pedestal portion. And in this case, a surface, which faces the protrusion top end, of the flange portion of the pedestal portion and a side surface, which is located on a protrusion top end side with respect to the flange portion, of the pedestal portion are connected through a second connecting portion that has a concave shape curving inwards in a cross section including the center axis of the ignition portion.

In a spark plug of configuration 6, the discharge portion of the ignition portion could be made of any one noble metal of Pt, Ir, Rh and Ru, or might be made of noble metal alloy containing at least one or more noble metals of these noble metals.

Effects of Invention

In the spark plug of the present invention, the melting portion is formed throughout the entire circumference of the ignition portion. That is, the discharge portion and the pedestal portion are held inwards in the radial direction by the melting portion, at sections where the discharge portion and the melting portion, and the pedestal portion and the melting portion are arranged in strata in the radial direction of the ignition portion. Therefore, when the discharge portion and the pedestal portion extend (deform) in the radial direction when subjected to heat, this extension is restrained or suppressed by their resistance to expansion towards radially outward. The resistance is contributed by the annular melting portion formed continuously in the circumferential direction of the ignition portion. Here, when viewing the profile line shape of the cross section of the ignition portion, the melting portion has a configuration that connects the side surface of the pedestal portion and the side surface of the discharge portion. Because of this, as compared with a case where the melting portion connects the side surface of the discharge portion and a plane that spreads out along the radial direction of the ignition portion (e.g. one side surface of the ground electrode or a top end surface of the pedestal portion), it is possible to lessen the restraint on the extension in the outward direction of the radial direction of the discharge portion by the melting portion.

In addition, according to the spark plug of the present invention, in the first cross section of the ignition portion, the exterior angle θ formed between the imaginary line that passes through the position X1 and the position X2 and the center axis of the ignition portion satisfies $135° \leqq \theta \leqq 175°$ as the definition. In a case where the exterior angle θ is less than 180°, a shape of the melting portion is such reverse tapered shape that the melting portion enlarges from the position X2 toward the position X1, and at the position X2, the melting portion is in a state in which the melting portion holds, inwards in the radial direction, the discharge portion. And, when the exterior angle θ becomes smaller, the greater the degree of broadening or divergence of the reverse tapered shape is, the higher the resistance of a structure of the melting portion itself to a pressing force in an outward direction of the radial direction is. Because of this, when the discharge portion is subjected to heat and deforms due to thermal expansion, the deformation in the outward direction of the radial direction of the discharge portion tends to be suppressed by the melting portion. In one specific example, when the exterior angle θ becomes smaller than 135°, internal stress increases at an interface between the discharge portion and the melting portion, then there is a risk that a crack or separation will appear. On the other hand, the pedestal portion has a larger linear expansion coefficient than that of the discharge portion. Since the deformation of the pedestal portion is greater as compared with the discharge portion when the deformation occurs due to the thermal expansion, the restraint on the deformation of the pedestal portion by the melting portion becomes greater, in comparison with the discharge portion. Even if the exterior angle θ is less than 180° and the shape of the melting portion is such reverse tapered shape that the melting portion enlarges from the position X2 toward the position X1, the pedestal portion is susceptible to the restraint on the deformation of the pedestal portion by the melting portion. In one specific example, when the exterior angle θ becomes larger than 175°, internal stress increases at an interface between the pedestal portion and the melting portion, and there is a risk that the crack or the separation will appear.

Here, the ignition portion is arranged at the position that faces the top end portion of the center electrode. However, regarding an expression "face" in the present invention, it does not express a state in which opposing surfaces of the top end portion and the ignition portion are arranged precisely parallel to each other. Also, it does not mean a configuration in which both axes of the center electrode and the ignition portion are exactly aligned with each other. That is, the configuration is not limited as long as the spark discharge gap GAP is formed between the top end portion of the center electrode and the ignition portion when power is applied to the spark plug of the present invention.

Further, according to the spark plug of the present invention, in the arbitrary cross section of the ignition portion, the proportion (melting portion forming proportion) of the forming depth T of the melting portion to the outside diameter S of the discharge portion is set to T/S, and when determining the melting portion forming proportion T/S, T/S≧0.5 is satisfied. Interposing the melting portion having an intermediate linear expansion coefficient between both linear expansion coefficients of the discharge portion and the pedestal portion between them is favorable for relaxation of thermal stress that occurs between the discharge portion and the pedestal portion. Since the greater the extending length (forming depth) T of the melting portion in the inward direction of the radial direction is, the larger the size of the melting portion interposed (intervening) between the discharge portion and the pedestal portion is, the thermal stress occurring between them can be relaxed. More specifically, when forming the melting portion so that the T/S becomes 0.5 or more, the occurrence of the crack or the separation can be effectively suppressed.

In the spark plug of the configuration 2, when forming the melting portion, in a case where, for example, spot welding is performed intermittently around the circumference of the ignition portion, shape of the melting portion formed is hard to be uniform throughout the entire circumference of the ignition portion. Further, the larger the interval of the laser beam radiation is, the more greatly the shape or the size of the melting portion differs according to the cross section. In such cases, cross sections that do not meet the definition, of the plurality of the cross sections which are arbitrary cross sections of the ignition portion and are observed from different circumferential direction positions with the center axis being the center, increase. When at least more than half of all arbitrary cross sections of the ignition portion throughout the entire circumference meet the definition, even if a portion where the internal stress partly increases at each interface between the discharge portion, the pedestal portion and the melting portion exists, the internal stress is easily dispersed, and the occurrence of the crack or the separation can be effectively suppressed.

In the spark plug of the configuration 3, when the discharge portion and the pedestal portion extend (deform) in the radial direction when subjected to heat, difference of the internal stress occurring at each interface between the discharge portion, the pedestal portion and the melting portion is limited, and unbalanced internal stresses can be suppressed, thereby suppressing the occurrence of the crack or the separation more effectively.

In the spark plug of the configuration 4, because the ignition portion is formed so as to protrude from the one side surface of the ground electrode, when building up a root portion of the ignition portion by providing the root portion with the first connecting portion, even in a case where the ignition portion is subjected to vibrations etc. due to engine drive, a structure that can sufficiently stand the load due to the vibrations can be obtained.

Furthermore, in the spark plug of the configuration 5, in the case where the flange portion is formed at the pedestal portion, stability of junction of the pedestal portion with the one side surface of the ground electrode can be increased. Then when building up the pedestal portion by providing the second connecting portion between the flange portion and the side surface of a body of the pedestal portion, a structure by which the ignition portion can sufficiently stand the load such as the vibrations imposed on its root portion can be obtained, same as the configuration 4, and this is desirable.

Moreover, in the spark plug of the configuration 6, forming the discharge portion, which forms the spark discharge gap between the center electrode and the discharge portion, using the noble metal or the noble metal alloy is favorable for obtaining resistance to oxidation and resistance to spark erosion.

EMBODIMENTS FOR CARRYING OUT THE INVENTION

Figure 1:
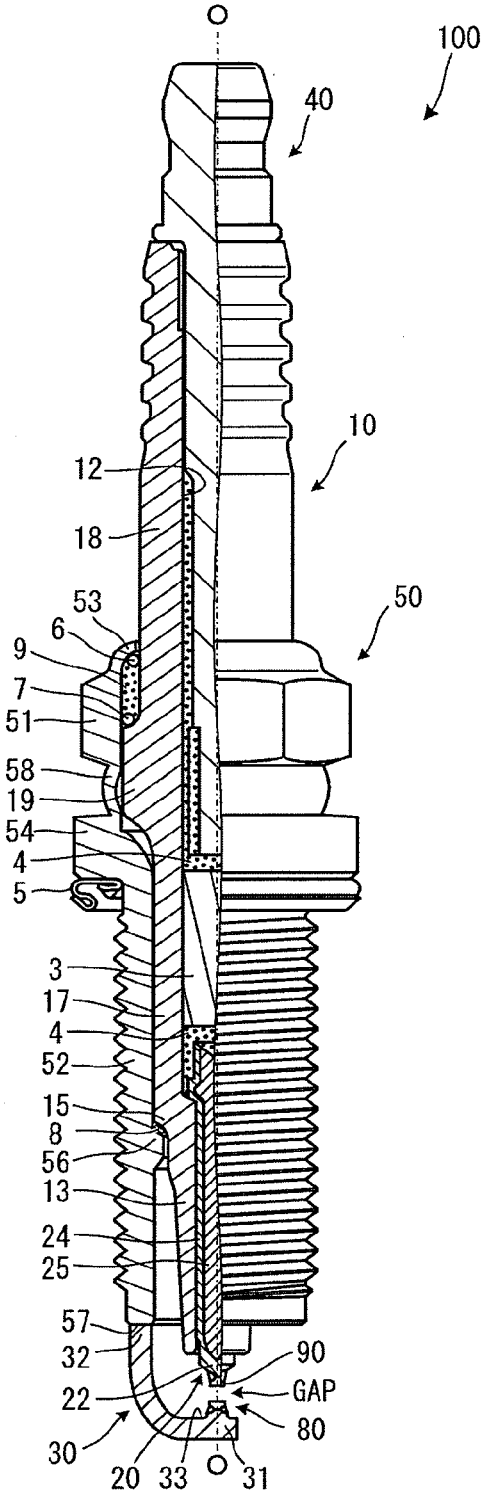
FIG. 1 is a local sectional view of a spark plug 100.
Figure 2:
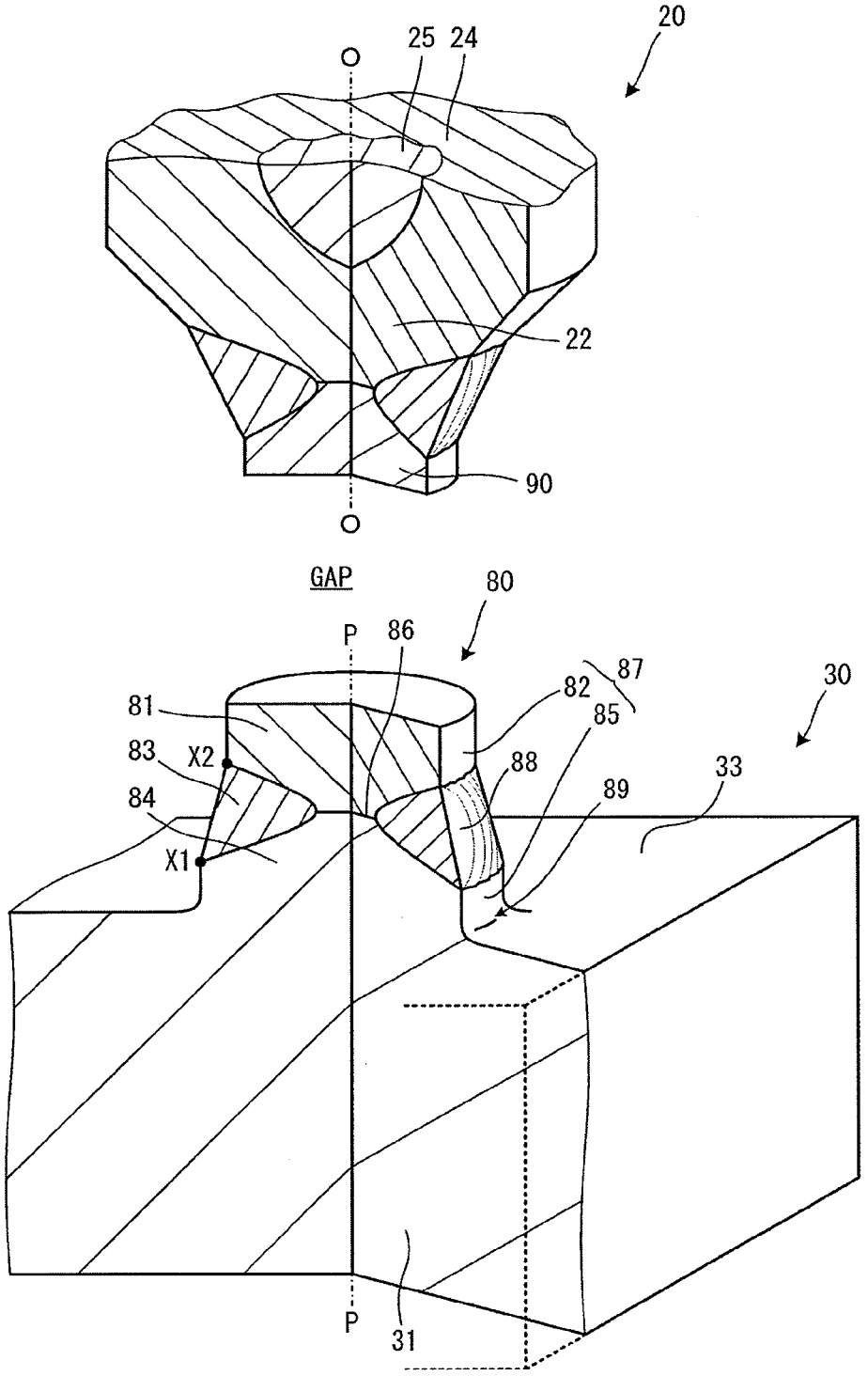
FIG. 2 is an enlarged local sectional view around a spark discharge gap GAP.

In the following description, embodiments of a spark plug of the present invention will be explained with reference to the drawings. First, a structure of a spark plug 100 as an example will be explained with reference to FIGS. 1 and 2. FIG. 1 is a local sectional view of the spark plug 100. FIG. 2 is an enlarged local sectional view around a spark discharge gap GAP. Here, in the explanation, in FIGS. 1 and 2, an axis O direction of the sparkplug 100 is defined as an up-and-down direction, and a lower side of the drawings is termed a top end side of the spark plug 100, and an upper side of the drawings is termed a rear end side of the spark plug 100.

As shown in FIG. 1, the spark plug 100 has a structure in which, a center electrode 20 is held inside an axial hole 12 of a ceramic insulator 10 at the top end side, a metal terminal 40 is provided at the rear end side, and the ceramic insulator 10 is secured by being covered with a metal shell (main metal) 50. Further, a ground electrode 30 is connected with the metal shell 50, and its other end portion (a top end portion 31) side is curved so as to face a top end portion 22 of the center electrode 20.

First, the ceramic insulator 10 of this spark plug 100 will be explained. The ceramic insulator 10 is made of a sintered ceramic material such as sintered alumina, and is substantially formed into a cylindrical shape with the axial hole 12 extending in the axis O direction formed in an axial center of the cylindrical shape. A brim portion 19 having a largest outside diameter is formed substantially in the middle in the axis O direction, and also a rear end side body 18 is formed on the rear end side of the brim portion 19 (i.e. on the upper side in FIG. 1). Further, a top end side body 17 whose outside diameter is smaller than that of the rear end side body 18 is formed on the top end side of the brim portion 19 (i.e. on the lower side in FIG. 1). Moreover, a leg portion 13 whose outside diameter is smaller than that of the top end side body 17 is formed on the top end side of the top end side body 17. The leg portion 13 tapers to its top, and is exposed to a combustion chamber when the spark plug 100 is installed in an engine cylinder head (not shown) of an internal combustion engine. Between the leg portion 13 and the top end side body 17, a stepped portion 15 is formed.

Next, the center electrode 20 will be explained. The center electrode 20 is a rod-shaped electrode, and has a body material 24 made of Ni-based alloy such as Inconel 600 or 601 (trademark) and a core material 25 which is made of Cu or Cu-based alloy having a higher thermal conductivity than that of the body material 24 and is embedded in the body material 24. The center electrode 20 is held on the top end side in the axial hole 12 of the ceramic insulator 10, and its top end portion 22 protrudes toward the top end side from a top end of the ceramic insulator 10. The top end portion 22 of the center electrode 20 is formed so that its diameter becomes smaller toward the top end side. Further, an electrode chip 90 that is made of noble metal is joined to a top end surface of the top end portion 22 to enhance resistance to spark erosion.

The center electrode 20 extends in the axial hole 12 of the ceramic insulator 10 toward the rear end side, and is electrically connected to the metal terminal 40 provided on the rear end side (i.e. on the upper side in FIG. 1) through a conductive sealing member 4 and a ceramic resistance 3, both of which extend along the axis O direction. Further, a high-tension cable (not shown) is connected to the metal terminal 40 via a plug cap (not shown), and a high voltage is applied.

Next, the metal shell 50 will be explained. The metal shell 50 is a substantially cylindrical shell for fixing the spark plug 100 to the engine cylinder head (not shown) of the internal combustion engine. The metal shell 50 covers a section from part of the rear end side body 18 to the leg portion 13 of the ceramic insulator 10, then holds the ceramic insulator 10 therein. The metal shell 50 is made of low-carbon steel, and provided with a tool engagement portion 51 to which a spark plug wrench (not shown) is fitted and a plug attachment portion 52 having screw thread to be screwed into a plug hole (not shown) of the engine cylinder head.

Furthermore, a brim-shaped seal portion 54 is provided between the tool engagement portion 51 and the plug attachment portion 52 of the metal shell 50. Also a ring-shaped gasket 5, formed by bending a plate material, is fitted to a screw neck between the seal portion 54 and the plug attachment portion 52. The gasket 5 is pressed and crushed then deformed between a seat surface of the seal portion 54 and an opening edge of the plug hole upon the installation of the spark plug 100 to the plug hole of the engine cylinder head, then serves to seal the opening edge for preventing engine gas leakage through the plug hole.

The metal shell 50 is also provided with a thin swage portion 53 on the rear end side of the tool engagement portion 51. In addition, a thin buckling portion 58 is provided between the seal portion 54 and the tool engagement portion 51. Between an inner circumferential surface of the metal shell 50 from the tool engagement portion 51 to the swage portion 53 and an outer circumferential surface of the rear end side body 18 of the ceramic insulator 10, annular ring members 6 and 7 are interposed. A talc powder (talc) 9 is filled between these annular ring members 6 and 7. The swage portion 53 is bent inwards by swaging, the ceramic insulator 10 is then pressed toward the top end side inside the metal shell 50 through the annular ring members 6, 7 and the talc 9. The metal shell 50 and the ceramic insulator 10 are therefore fixedly connected with each other, with the stepped portion 15 of the ceramic insulator 10 supported on a stepped part 56 that is formed at a position of the plug attachment portion 52 on the inner circumferential surface of the metal shell 50 via a ring-shaped plate packing 8. With this hermetically and tightly sealed contact between the metal shell 50 and the ceramic insulator 10 via the plate packing 8, combustion gas leakage can be prevented. Here, the buckling portion 58 is formed so as to be bent and deformed outwards by an application of a compression force during the swaging, then a compression length of the talc 9 in the axis O direction is increased and the gas-tightness of the metal shell 50 is improved.

Next, the ground electrode 30 will be explained. The ground electrode 30 is a rod-shaped electrode having a rectangular cross section. One end portion (a base end portion 32) of the ground electrode 30 is fixedly connected with a top end surface 57 of the metal shell 50. The ground electrode 30 extends in the axis O, and curves so that one side surface (an inner surface 33) of the other end portion (the top end portion 31) of the ground electrode 30 faces the top end portion 22 of the center electrode 20. The ground electrode 30 is made of Ni-based alloy such as Inconel 600 or 601 (trademark), same as the center electrode 20.

The top end portion 31 of this ground electrode 30 is provided with an ignition portion 80 that protrudes from the inner surface 33 toward the top end portion 22 of the center electrode 20. The ignition portion 80 is formed at a position that faces the top end portion 22 of the center electrode 20 (more specifically, the electrode chip 90 joined to the top end portion 22), and the spark discharge gap GAP is formed between both the ignition portion 80 and the top end portion 22 (the electrode chip 90). Here, with regard to a relationship of the opposing position of the ignition portion 80 and the top end portion 22 of the center electrode 20, opposing surfaces of the ignition portion 80 and the electrode chip 90 cannot necessarily be in an exact opposing positioning state as long as the spark discharge gap GAP is formed between the both portions. Thus, the axis O of the spark plug 100 and a center axis P (see FIG. 2) of the ignition portion 80 cannot necessarily be precisely identical with each other. Here, the center axis P of the ignition portion 80 is a straight line or its approximate straight line which passes through a middle of a cross section of the ignition portion 80 orthogonal to the protruding direction of the ignition portion 80 (i.e. the direction in which the ignition portion 80 protrudes from the inner surface 33 of the ground electrode 30 toward the center electrode 20) and also is parallel to the protruding direction.

As shown in FIG. 2, the ignition portion 80 has a pedestal portion 84 that is formed on the inner surface 33 of the ground electrode 30 and a discharge portion 81 that is joined to the pedestal portion 84. The pedestal portion 84 is a columnar shaped portion that is formed by the fact that a part of the inner surface 33 protrudes toward the top end portion 22 at the position facing the top end portion 22 of the center electrode 20 on the inner surface 33 of the ground electrode 30. A connecting portion (a first connecting portion) 89 having a concave shape in cross section, which curves inwards, is provided at a boundary part between a side surface 85 of the pedestal portion 84 and the inner surface 33. The side surface 85 and the inner surface 33 are connected through this connecting portion 89.

The discharge portion 81 also has a columnar shape. The discharge portion 81 is fixedly connected with the pedestal portion 84 by laser welding with the discharge portion 81 set on a protrusion top end 86 of the pedestal portion 84. The discharge portion 81 is formed using Pt alloy, and has excellent resistance to oxidation and excellent resistance to spark erosion. As a constituent material of the discharge portion 81, not only the Pt alloy but also any one noble metal of Pt, Ir, Rh and Ru are used. Or noble metal alloy that contains at least one or more noble metals of these noble metals could be used. Then a melting portion 83, in which constituent materials (components) of both of the discharge portion 81 and the pedestal portion 84 melt or blend with each other and are mixed together, is formed at a joining portion between the discharge portion 81 and the pedestal portion 84.

In the spark plug 100 having such structure or configuration of this embodiment, junction between the discharge portion 81 and the pedestal portion 84 which form the ignition portion 80 is formed by the laser welding as described above. More specifically, the ignition portion 80 is formed as follows. The pedestal portion 84 protruding from the inner surface 33 is formed, for example, through pressing and cutting working of the ground electrode 30. Further, the columnar discharge portion 81 is formed by using the noble metal or the noble metal alloy, and is put or superposed on the protrusion top end 86 of the pedestal portion 84 with both axis directions brought into alignment with each other. A diameter of the pedestal portion 84 is set to be slightly larger than that of the discharge portion 81. Thus, in a state before the welding, a part (a brim or rim or edge portion) of the protrusion top end 86 of the pedestal portion 84 projects out in an outward direction with respect to the discharge portion 81 when setting the discharge portion 81 on the pedestal portion 84. In this state, a laser beam is radiated from a side surface 82 of the discharge portion 81 and the side surface 85 of the pedestal portion 84 (i.e. from a side surface 87 of the ignition portion 80 after completion of the ignition portion 80) toward the center axis P so that the laser beam is directed to a junction or joining surface between the discharge portion 81 and the pedestal portion 84. With this laser beam radiation, the melting portion 83, in which the constituent materials of both of the discharge portion 81 and the pedestal portion 84 melt or blend with each other and are mixed together, is formed between the discharge portion 81 and the pedestal portion 84. At this time, the edge portion of the protrusion top end 86, projecting out from the discharge portion 81, melts, then the side surface 82 of the discharge portion 81 and the side surface 85 of the pedestal portion 84 are connected with or joined to each other through an exposure surface 88 of the melting portion 83. The laser welding is performed in a circumferential direction of the center axis P around the ignition portion 80, and the discharge portion 81 and the pedestal portion 84 are connected with or joined to each other through the melting portion 83. The radiation of the laser beam could be performed continuously or intermittently. In the case where the laser beam radiation is performed intermittently, it is desirable that a radiation position of the laser beam overlap with an adjacent radiation position so that a position of the joining surface between the discharge portion 81 and the pedestal portion 84, viewed from an outer circumferential side of the ignition portion 80, becomes the melting portion 83.

With regard to the melting portion 83 formed in this manner, in this embodiment, its configuration or figure, when viewing an arbitrary cross section including the center axis P of the ignition portion 80, is determined as follows. First, the melting portion 83 is formed so as to extend toward the center axis P from the both side surfaces 87, placed on opposite sides of the center axis P, of the ignition portion 80 between the discharge portion 81 and the pedestal portion 84. Further, when viewing a profile line shape of the ignition portion 80 on the cross section (namely, when viewing a cross section shape of the exposure surface 88 of the ignition portion 80), the melting portion 83 has a configuration that connects the side surface 82 of the discharge portion 81 and the side surface 85 of the pedestal portion 84. Thus the exposure surface 88 of the melting portion 83 does not connect or join to the inner surface 33 of the ground electrode 30.

Figure 3:
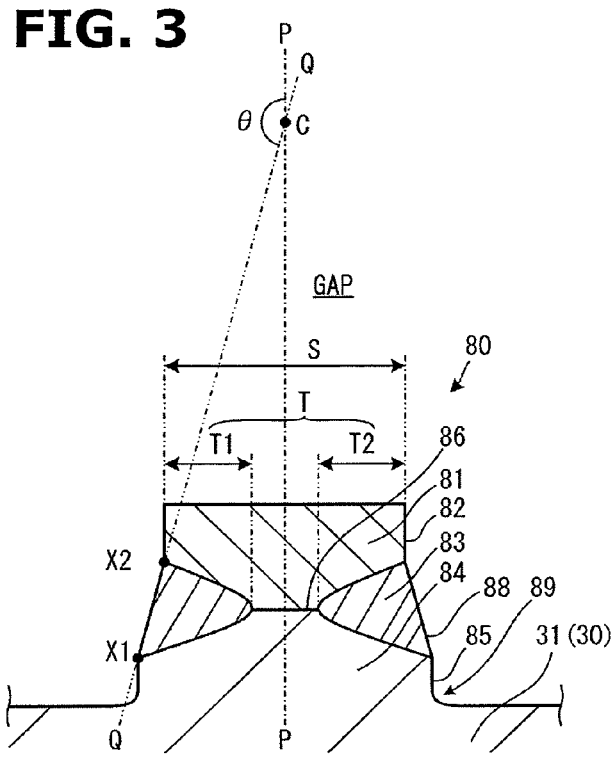
FIG. 3 is a drawing showing a first cross section of an ignition portion 80.

In addition, in the profile line shape of the arbitrary cross section of the ignition portion 80, a boundary position between the pedestal portion 84 and the melting portion 83 (a boundary position between the side surface 85 and the exposure surface 88 on the cross section), at one side surface side of the ignition portion 80, is set to X1. Likewise, a boundary position between the discharge portion 81 and the melting portion 83 (a boundary position between the side surface 82 and the exposure surface 88 on the cross section) is set to X2. Next, the position X1 and the position X2 are joined by a straight line, and a cross section in which a distance of the straight line of the position X1 and the position X2 becomes a maximum is selected from among a plurality of cross sections that are conceivable as the above arbitrary cross section, and this selected cross section is set to a first cross section of the ignition portion 80. This first cross section is shown in FIG. 3. In the first cross section, an imaginary line Q that passes through the position X1 and the position X2 is set, then an exterior angle θ formed between the imaginary line Q and the center axis P of the ignition portion 80 at a point C where the imaginary line Q and the center axis P cross is determined. This embodiment provides that $135° \leqq \theta \leqq 175°$ is satisfied as the exterior angle θ.

A coefficient of linear expansion of the discharge portion 81 made of the Pt alloy is smaller than those of the ground electrode 30 and the pedestal portion 84 made of Ni alloy. A linear expansion coefficient of the melting portion 83, in which constituent materials of both of the discharge portion 81 and the pedestal portion 84 melt or blend with each other and are mixed together, takes on an intermediate linear expansion coefficient between both linear expansion coefficients of the discharge portion 81 and the pedestal portion 84. In a case where the ignition portion 80 is subjected to heat due to engine drive, deformation of the discharge portion 81 and the pedestal portion 84 including the melting portion 83 occurs, and these portions extend. With regard to the center axis P direction, since the discharge portion 81, the melting portion 83 and the pedestal portion 84 are arranged in strata (the discharge portion 81, the melting portion 83 and the pedestal portion 84 have a layered arrangement) and the discharge portion 81 faces the spark discharge gap GAP, when the discharge portion 81, the melting portion 83 and the pedestal portion 84 extend (deform) in the center axis P direction, less restraint on this extension is imposed. On the other hand, since the melting portion 83 is formed inwards in a radial direction throughout a circumference of the side surface 87 of the ignition portion 80, the discharge portion 81 and the pedestal portion 84 are held inwards in the radial direction by the melting portion 83, at sections where the discharge portion 81 and the melting portion 83, the pedestal portion 84 and the melting portion 83 are arranged in strata in the radial direction of the center axis P. Because of this, when the discharge portion 81 and the pedestal portion 84 extend (deform) in the radial direction, this extension is restrained or suppressed by the melting portion 83.

With regard to the cross section shape of the exposure surface 88 of the melting portion 83, when focusing attention on a direction that connects the position X1 and the position X2 (an extending direction in which the imaginary line Q extends), at the position X2, the smaller the exterior angle θ is, the greater the component of an inward direction of the radial direction of components of the extending direction is. When the melting portion 83 has a reverse tapered shape, the melting portion 83 is in a state in which the melting portion 83 holds, inwards in the radial direction, the discharge portion 81 whose diameter is smaller than that of the pedestal portion 84. And, the greater the degree of broadening or divergence of the reverse tapered shape is, the higher the resistance of a structure of the melting portion 83 itself to a pressing force in an outward direction of the radial direction is. Because of this, when the discharge portion 81 is subjected to heat and deforms due to thermal expansion, the deformation in the outward direction of the radial direction of the discharge portion 81 tends to be suppressed by the melting portion 83, as described above. For this reason, internal stress increases at an interface between the discharge portion 81 and the melting portion 83. According to an after-mentioned embodiment 1, when the exterior angle 19 becomes smaller than 135°, there is a risk that a crack or separation will appear.

On the other hand, the linear expansion coefficient of the pedestal portion 84 is larger than that of the discharge portion 81. When the deformation occurs due to the thermal expansion, the deformation of the pedestal portion 84 is greater than that of the discharge portion 81.

With regard to the cross section shape of the exposure surface 88 of the melting portion 83, when focusing attention on the direction that connects the position X1 and the position X2 (the direction in which the imaginary line Q extends), at the position X1, the larger the exterior angle θ is, the smaller the component of the outward direction of the radial direction of components of the extending direction is. That is, at the position X1, the larger the exterior angle θ is, the greater the restraint on the deformation of the pedestal portion 84 by the melting portion 83 is. Since the deformation, due to the thermal expansion, of the pedestal portion 84 is greater as compared with the discharge portion 81, even if the exterior angle θ is less than 180°, the pedestal portion 84 is susceptible to the restraint on the deformation of the pedestal portion 84 by the melting portion 83. For this reason, according to the after-mentioned embodiment 1, when the exterior angle θ becomes larger than 175°, internal stress increases at an interface between the pedestal portion 84 and the melting portion 83, and there is a risk that the crack or the separation will appear.

Next, in the above arbitrary cross section of the ignition portion 80 (for convenience sake, an explanation will be made using the first cross section in FIG. 3), an outside diameter of the discharge portion 81 in the radial direction of the center axis P of the ignition portion 80 is set to S. Further, an extending length (a forming depth) of the melting portion 83 in the inward direction of the radial direction is set to T with the position X2 (the boundary position between the side surface 82 of the discharge portion 81 and the exposure surface 88 of the melting portion 83 on the cross section) being the reference. As mentioned above, the melting portion 83 is formed from the side surface 87 of the ignition portion 80 toward the center axis P, and if its forming depth does not reach the center axis P, as shown in FIG. 3, the melting portion 83 is divided into two of right and left side portions with respect to the center axis P on the cross section of the ignition portion 80. Therefore, the extending length T of the melting portion 83 in the inward direction of the radial direction on the cross section of the ignition portion 80 is defined as a total length of an extending length T1 in the inward direction of the radial direction at the left hand side with respect to the center axis P and an extending length T2 in the inward direction of the radial direction at the right hand side with respect to the center axis P. Then, proportion (melting portion forming proportion) of the forming depth T of the melting portion 83 to the outside diameter S of the discharge portion 81 is set to T/S. When determining the melting portion forming proportion T/S, this embodiment provides that $T/S \geqq 0.5$ is satisfied.

Interposing the melting portion 83 having the intermediate linear expansion coefficient between both linear expansion coefficients of the discharge portion 81 and the pedestal portion 84 between them is favorable for relaxation of thermal stress that occurs between the discharge portion 81 and the pedestal portion 84. The greater the extending length T of the melting portion 83 in the inward direction of the radial direction of the ignition portion 80 from the position X2 is, the larger the size of the melting portion 83 interposed (intervening) between the discharge portion 81 and the pedestal portion 84 is. Hence, the thermal stress occurring between the discharge portion 81 and the pedestal portion 84 can be relaxed, thereby effectively suppressing the occurrence of the crack or the separation. According to an after-mentioned embodiment 2, the following tendency was shown; the smaller the T/S, the greater the proportion (oxide scale) of size of the crack occurring at each interface between the discharge portion 81, the pedestal portion 84 and the melting portion 83 on the cross section of the ignition portion 80. Then it was found that, when forming the melting portion 83 so that the T/S becomes 0.5 or more, the oxide scale can be limited to less than 50%.

With regard to the above provision or definition (or condition), i.e. $135° \leqq \theta \leqq 175°$ and $T/S \geqq 0.5$, it is desirable that not only the first cross section but also more than half of all cross sections throughout the entire circumference, which are arbitrary cross sections of the ignition portion 80 and are observed from different circumferential direction positions with the center axis P being a center, meet the definition. When forming the melting portion 83, in a case where, for example, spot welding is performed intermittently around the circumference of the ignition portion 80, shape of the melting portion 83 formed is hard to be uniform throughout the entire circumference of the ignition portion 80. Further, the larger the interval of the laser beam radiation is, the more greatly the shape or the size of the melting portion 83 differs according to the cross section. In such cases, cross sections that do not meet the definition, of the plurality of the cross sections which are arbitrary cross sections of the ignition portion 80 and are observed from different circumferential direction positions with the center axis P being the center, increase. When at least more than half of all arbitrary cross sections of the ignition portion throughout the entire circumference meet the definition, even if a portion where the internal stress partly increases at each interface between the discharge portion 81, the pedestal portion 84 and the melting portion 83 exists, the internal stress is easily dispersed, and the effect of suppressing the occurrence of the crack or the separation is obtained.

Here, according to a result of the after-mentioned embodiment 1, it is desirable to decide or select the constituent materials of the discharge portion 81 and the pedestal portion 84 so that a difference between the linear expansion coefficient of the constituent material of the discharge portion 81 and the linear expansion coefficient of the constituent material of the pedestal portion 84 is $8.1 \times 10^{-6}$ [1/K] or less. With this setting, when the discharge portion 81 and the pedestal portion 84 extend (deform) in the radial direction when subjected to heat, difference of the internal stress occurring at each interface between the discharge portion 81, the pedestal portion 84 and the melting portion 83 is limited, and unbalanced internal stresses can be suppressed, thereby suppressing the occurrence of the crack or the separation more effectively.

Furthermore, in the present embodiment, as explained above, the side surface 85 of the pedestal portion 84 and the inner surface 33 of the ground electrode 30 are connected through the connecting portion 89. Because the ignition portion 80 is formed so as to protrude from the inner surface 33 of the ground electrode 30, for instance, in a case where the ignition portion 80 is subjected to vibrations etc. due to engine drive, a load by the vibrations tends to be imposed on a root portion of the ignition portion 80. Here, if the melting portion 83 is formed so as to connect the side surface 82 of the discharge portion 81 and the inner surface 33 of the ground electrode 30, since a thickness of the root portion of the ignition portion 80 increases and the melting portion 83 is in a state in which the melting portion 83 holds the ignition portion 80, a structure by which the ignition portion 80 can sufficiently stand the load imposed on the root portion can be obtained. However, in the present embodiment, for the sake of reducing the influence of the internal stress applied to the each interface between the melting portion 83 and the discharge portion 81 also the melting portion 83 and the pedestal portion 84, the structure in which the exposure surface 88 of the melting portion 83 connects the side surface 82 of the discharge portion 81 and the side surface 85 of the pedestal portion 84 is employed. In view of the foregoing, in order for the ignition portion 80 to have the structure that can stand the load imposed on the root portion of the ignition portion 80, as described above, the connecting portion 89 is provided between the side surface 85 of the pedestal portion 84 and the inner surface 33 of the ground electrode 30.

In addition, needless to say, modifications and variations of each structure are possible in the present invention. For example, although the discharge portion 81 and the pedestal portion 84 are joined by the laser welding, these portions could be joined by electron beam welding. Further, regarding the laser welding, it is not limited to a manner in which the laser beam is radiated from a direction orthogonal to the center axis P with the laser beam directed to the junction or joining surface between the discharge portion 81 and the pedestal portion 84. For instance, the melting portion 83 could be formed in a manner in which the laser beam is radiated from a slanting direction with respect to the center axis P with the laser beam directed to the junction or joining surface between the discharge portion 81 and the pedestal portion 84.

Figure 4:
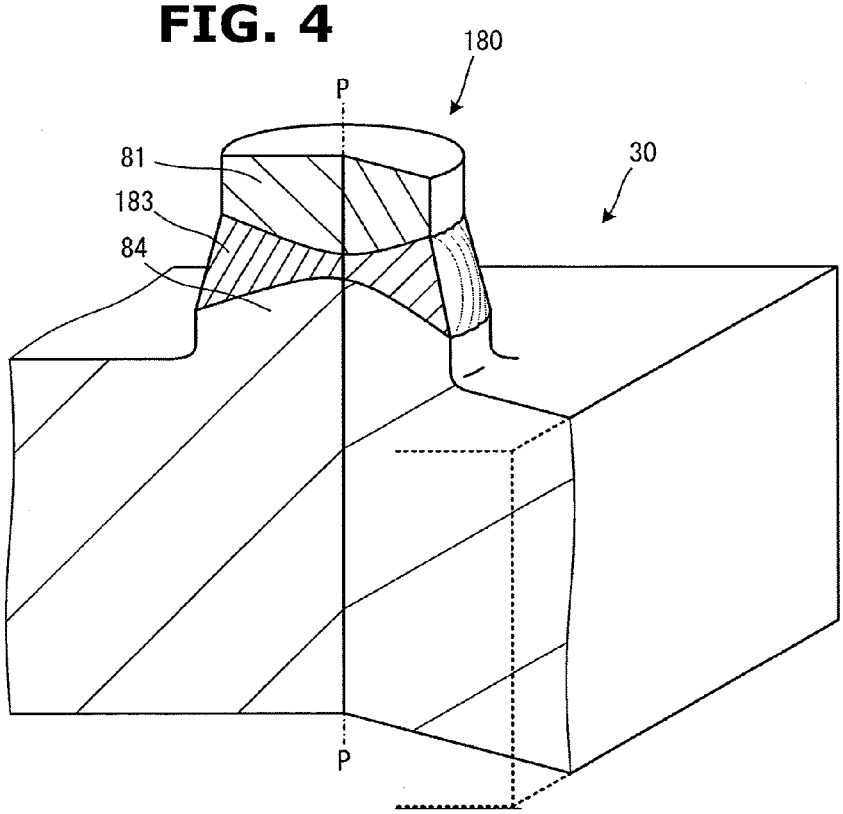
FIG. 4 is a drawing showing an ignition portion 180 as a modification.

Furthermore, as shown in FIG. 4, in an ignition portion 180, a melting portion 183 formed between the discharge portion 81 and the pedestal portion 84 could have a structure in which its forming depth reaches the center axis P and one side portion and the other side portion with respect to the center axis P on a cross section of the ignition portion 180 are continuously joined to each other.

Figure 5:
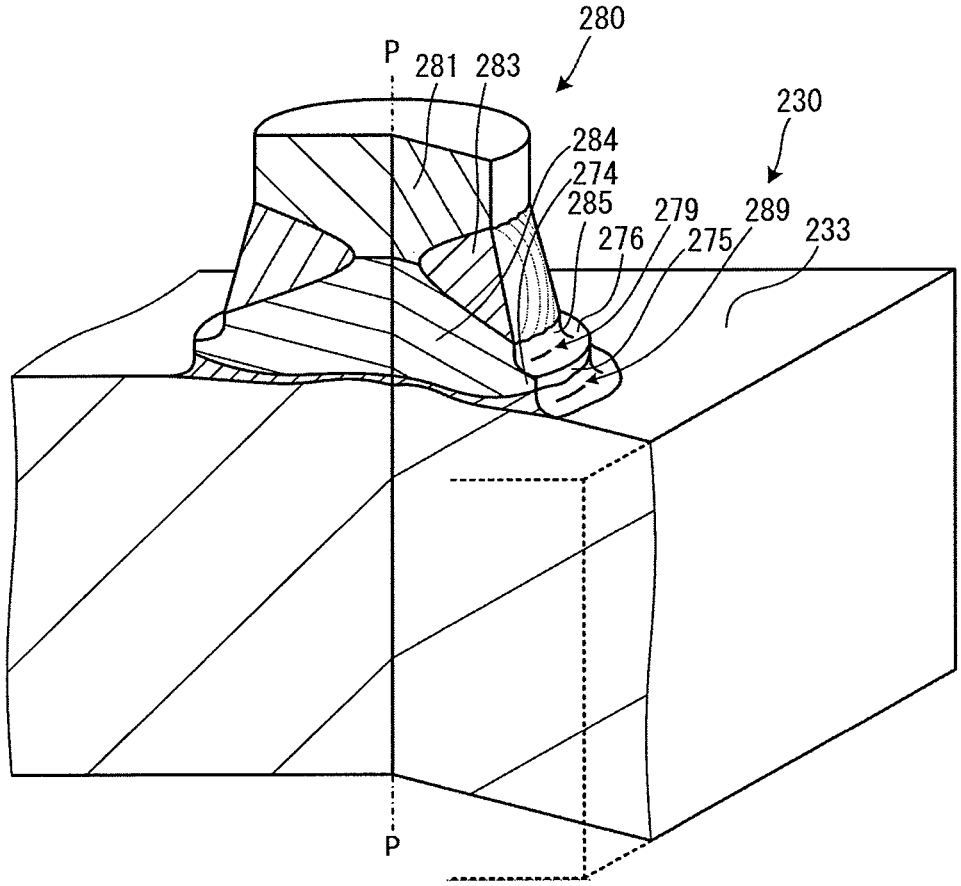
FIG. 5 is a drawing showing an ignition portion 280 as a modification.

Moreover, a structure of an ignition portion 280, shown in FIG. 5, could be employed. In the ignition portion 280, a pedestal portion 284 and a ground electrode 230 are formed individually, these pedestal portion 284 and ground electrode 230 are joined, for example, by resistance welding, and a melting portion 283 is formed by performing the laser welding of the pedestal portion 284 and a discharge portion 281, same as the present embodiment. Then the above-mentioned definition is satisfied at a junction between the discharge portion 281 and the pedestal portion 284. With respect to the pedestal portion 284, a flange portion 274 formed by enlarging an outside diameter of the pedestal portion 284 could be formed at an end portion, on a ground electrode 230 side, of the pedestal portion 284. By connecting this flange portion 274 and an inner surface 233 of the ground electrode 230, it is possible to secure a large junction area and to obtain a more stable junction property. Further, when a connecting portion (a first connecting portion) 289, same as the above connecting portion 89, is provided between a side surface 275 of the flange portion 274 and the inner surface 233 of the ground electrode 230, a structure by which the ignition portion 280 can stand a load (vibrations etc.) imposed on its own root portion can be obtained. Additionally, also between a top end surface 276 (a surface facing a protrusion top end side of the ignition portion 280) of the flange portion 274 and a side surface 285 of the pedestal portion 284, a connecting portion (a second connecting portion) 279 having a concave shape in cross section, which curves inwards, and connecting both surfaces 276 and 285, is provided. When providing this connecting portion 279, the ignition portion 280 has a structure that can stand a load imposed around a boundary between the pedestal portion 284 and the flange portion 274, and this structure is desirable.

Embodiment 1

Evaluation test was conducted to verify the effect by providing the definition to the configuration of the melting portion 83 formed at the ignition portion 80 provided on the ground electrode 30 of the spark plug 100. First, evaluation concerning a relationship between the degree of inclination (inclination by the exterior angle θ) of the exposure surface 88 of the melting portion 83 and separation resistance and a relationship between the difference in the linear expansion coefficient of the constituent material between the discharge portion 81 and the pedestal portion 84 which form the ignition portion 80 and the separation resistance, was carried out. In this evaluation test, four different materials made of noble metal alloy, respectively having 8.3, 9.7, 10.4 and 13.4 ($\times 10^{-6}$) [1/K] as the linear expansion coefficient at 1000° C., were prepared, and the discharge portion whose outside diameter S is set to 0.7 mm was made for each material. Further, the ground electrode was made using Ni alloy whose linear expansion coefficient at 1000° C. is $17.8\times 10^{-6}$ [1/K], and the pedestal portion was formed through the pressing working of the inner surface of the ground electrode. Furthermore, the discharge portion was set on the pedestal portion, and the laser beam was radiated from the side of both portions toward the junction or joining surface between both portions to join both portions together by the laser welding around the circumference thereof. Then evaluation samples (samples) of the ground electrode where the ignition portion is formed on the inner surface were produced. Here, with regard to the laser welding, the radiation position, a radiation angle, power and radiation time etc. of the laser beam were controlled so that the forming depth (the extending length T in the inward direction of the radial direction) of the melting portion formed between the pedestal portion and the discharge portion satisfied S/T=1 (namely that one side melting portion and the other side melting portion with respect to the center axis P on the cross section of the ignition portion were continuously joined to each other) and also the different exterior angles θ were formed. Then, for each sample produced in this way, a section in which a distance of the straight line between the position X1 and the position X2 becomes a maximum was identified, and the exterior angle θ formed between the imaginary line Q and the center axis P was measured.

Next, for each sample, a heating/cooling test was conducted on a desktop. The whole ignition portion of each sample was heated for two minutes with a burner so that a reaching temperature was 1100° C., and was cooled (cooled slowly) at atmospheric temperature for one minute after the heating. This heating and cooling process was one cycle, and 1000 cycles were carried out. Subsequently, observation of the melting portion was made using a microscope after cutting the ignition portion of each sample at the cross section that passes through the center axis P. Then, an area where the crack or the separation appeared in the melting portion was observed, and its appearing position was classified into two; a position around a boundary between the discharge portion and the melting portion and a position around a boundary between the pedestal portion and the melting portion, and further each length in the radial direction of the crack or the separation was measured.

Figure 6:
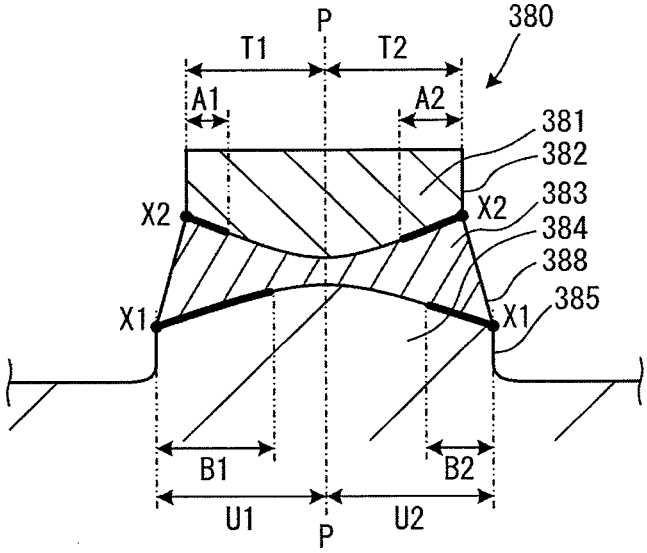
FIG. 6 is a sectional view of an ignition portion 380 shown as an example for explaining a method of determining oxide scale.

Here, an ignition portion 380 of the sample, shown in FIG. 6, will be explained as an example. In a cross section including a center axis P of the ignition portion 380, an extending length of a melting portion 383 in the inward direction of the radial direction on one side (on a left hand side in FIG. 6) in the radial direction with respect to the center axis P is set to T1, and an extending length of the melting portion 383 in the inward direction of the radial direction on the other side (on a right hand side in FIG. 6) is set to T2, with a boundary position X2 between a discharge portion 381 and the melting portion 383 (a boundary position between a side surface 382 and an exposure surface 388) being the reference. Further, an extending length in the radial direction of the crack or the separation appearing at a boundary between the discharge portion 381 and the melting portion 383 on one side in the radial direction with respect to the center axis P is set to A1, and an extending length of the crack or the separation on the other side is set to A2. Then the proportion (oxide scale) of length of the crack or the separation appearing at the boundary between the discharge portion 381 and the melting portion 383 is determined by the following expression.

$$\{(A1+A2)/(T1+T2)\}\times 100[\%] \quad (1)$$

Next, likewise, an extending length of a melting portion 383 in the inward direction of the radial direction on one side in the radial direction with respect to the center axis P is set to U1, and an extending length of the melting portion 383 in the inward direction of the radial direction on the other side is set to U2, with a boundary position X1 between a pedestal portion 384 and the melting portion 383 (a boundary position between a side surface 385 and the exposure surface 388) being the reference. Further, an extending length in the radial direction of the crack or the separation appearing at a boundary between the pedestal portion 384 and the melting portion 383 on one side in the radial direction with respect to the center axis P is set to B1, and an extending length of the crack or the separation on the other side is set to B2. Then the proportion (oxide scale) of length of the crack or the separation appearing at the boundary between the pedestal portion 384 and the melting portion 383 is determined by the following expression.

$$\{(B1+B2)/(U1+U2)\}\times 100[\%] \quad (2)$$

The proportion of length of the crack or the separation appearing at the boundary between the discharge portion 381 and the melting portion 383 obtained by the expression (1) and the proportion of length of the crack or the separation appearing at the boundary between the pedestal portion 384 and the melting portion 383 obtained by the expression (2), are compared. And a larger proportion of the two proportions of length of the crack or the separation is used as the oxide scale of the ignition portion.

In a case where the oxide scale of the ignition portion is less than 25%, even if the crack or the separation appears, it is judged that this is not a problem, then evaluation of [◎] is made. In a case where the oxide scale is greater than or equal to 25% and less than 50%, it is judged that its influence is small, then evaluation of [○] is made. However, in a case where the oxide scale is greater than or equal to 50%, it is judged that there is a risk that the discharge portion would drop or fall off, then evaluation of [X] is made. A result of this evaluation test is shown in Table 1 by classification by the exterior angle θ formed between the imaginary line Q and the center axis P and the difference in the linear expansion coefficient of the constituent material between the discharge portion and the pedestal portion.

TABLE 1

| | | | | | |
|---|---|---|---|---|---|
| Coefficient of Linear Expansion × $10^{-6}$[1/K] | Discharge Portion | 13.4 | 10.4 | 9.7 | 8.3 |
| | Pedestal Portion | | 17.8 | | |
| | Difference | 4.4 | 7.4 | 8.1 | 9.5 |
| Exterior Angle θ [°] | 123 | | X | | |
| | 125 | | | X | |
| | 128 | X | | | |
| | 132 | | | | X |
| | 134 | | X | | X |
| | 135 | ◎ | | ◎ | |
| | 142 | | | | ○ |
| | 168 | | ◎ | | |
| | 175 | ◎ | | | ○ |
| | 178 | X | | X | |
| | 183 | | X | | |
| | 195 | | | X | |
| | 210 | | | | X |

As shown in Table 1, samples whose exterior angles θ formed between the imaginary line Q and the center axis P are less than 135° show the oxide scale of the ignition portion of 50% or more. Also regarding samples whose exterior angles θ exceed 175°, most of these samples show the oxide scale of the ignition portion of 50% or more, and it is found that these samples are not favorable for the separation resistance. On the other hand, with regard to samples whose exterior angles θ are 135° or more and 175° or less, each oxide scale of the ignition portion is less than 50%, and it is ascertained that a good result separation resistance can be obtained. Furthermore, regarding samples whose differences in the linear expansion coefficient of the constituent material between the discharge portion and the pedestal portion are $8.1\times10^{-6}$ [1/K] or less among the samples whose exterior angles θ are 135° or more and 175° or less, the oxide scale of the ignition portion is less than 25%. Therefore, it is ascertained that, when setting the differences in the linear expansion coefficient of the constituent material between the discharge portion and the pedestal portion to $8.1\times10^{-6}$ [1/K] or less, a better result for the separation resistance can be obtained.

Embodiment 2

Next, evaluation concerning a relationship between the extending length (the forming depth) of the melting portion 83 in the inward direction of the radial direction and the separation resistance, was carried out. In this evaluation test, two different discharge portions whose outside diameters S are set to 0.7 mm and 1.2 mm were made using material made of Pt alloy having $10.4\times10^{-6}$ [1/K] as the linear expansion coefficient at 1000° C. Further, the ground electrode was made using Ni alloy whose linear expansion coefficient at 1000° C. is $17.8\times10^{-6}$ [l/K], and the pedestal portion was formed through the pressing working of the inner surface of the ground electrode. Furthermore, the discharge portion was set on the pedestal portion, and the laser beam was radiated from the side of both portions toward the junction or joining surface between both portions to join both portions together by the laser welding around the circumference thereof. Then evaluation samples (samples) of the ground electrode where the ignition portion is formed on the inner surface were produced. Here, with regard to the laser welding, the power (intensity) of the laser beam was controlled so that the different forming depths of the melting portion formed were formed. Then, same as the embodiment 1, the exterior angle θ formed between the imaginary line Q and the center axis P was measured, and samples that meet 135°≦θ≦175° were extracted as an object of evaluation.

Next, for each extracted sample, the same heating/cooling test as the embodiment 1 was conducted. Subsequently, observation of the melting portion was made using the microscope after cutting the ignition portion of each sample at the cross section that passes through the center axis P, and measurement of the forming depth (the extending length T in the inward direction of the radial direction) of the melting portion was made, then the melting portion forming proportion T/S was determined. Further, an area where the crack or the separation appeared in the melting portion for each sample was observed, and its appearing position was classified into two; a position around a boundary between the discharge portion and the melting portion and a position around a boundary between the pedestal portion and the melting portion, and further each length in the radial direction of the crack or the separation was measured. Furthermore, the proportion (oxide scale) of length of the crack or the separation appearing at the ignition portion is determined using the above expressions (1) and (2), and the same evaluation as the embodiment 1 was carried out. A result of this evaluation test is shown in Table 2.

TABLE 2

| Sample | 1 | 2 | 3 | 4 | 5 | 6 | 7 | 8 |
|---|---|---|---|---|---|---|---|---|
| Discharge Portion Outside Diameter S[mm] | 0.70 | | | | 1.20 | | | |
| Melting Portion Length T[mm] | 0. 28 | 0.35 | 0.54 | 0.70 | 0.43 | 0.60 | 0.84 | 1.20 |
| Melting Portion Forming Proportion T/S | 0.40 | 0.50 | 0.77 | 1.00 | 0.36 | 0.50 | 0.70 | 1.00 |
| Exterior Angle θ [°] | 168 | 165 | 171 | 163 | 168 | 155 | 165 | 170 |
| Oxide Scale | 88.6% | 35.1% | 15.3% | 11.2% | 100% | 47.6% | 22.9% | 17.6% |
| Evaluation | X | ○ | ◎ | ◎ | X | ○ | ◎ | ◎ |

As shown in Table 2, with regard to samples 3, 4, 7 and 8 whose melting portion forming proportions T/S are 0.70 or more, each oxide scale is less than 25%, and it is ascertained that a good result for the separation resistance can be obtained. Further, it is found that when the melting portion forming proportion T/S is 0.50 or more, like samples 2 and 6, the oxide scale can be controlled or suppressed to less than 50%. However, it is found that when the melting portion forming proportion T/S is less than 0.50, like samples 1 and 5, the oxide scale of the ignition portion is 50% or more, and this is not favorable for the separation resistance.

EXPLANATION OF REFERENCE SIGN

| | |
|---|---|
| 10 | ceramic insulator |
| 12 | axial hole |
| 20 | center electrode |
| 30 | ground electrode |
| 31 | top end portion |
| 33 | inner surface |
| 50 | metal shell (main metal) |
| 80, 180, 280 | ignition portion |
| 81 | discharge portion |
| 82 | side surface |
| 83 | melting portion |
| 84 | pedestal portion |
| 85, 285 | side surface |
| 86 | protrusion top end |
| 87 | side surface |
| 89, 289 | connecting portion |
| 100 | spark plug |
| 274 | flange portion |
| 276 | top end surface |
| 279 | connecting portion |

The invention claimed is:

1. A spark plug comprising:

a center electrode;

a ceramic insulator which has an axial hole extending along an axis direction and holds the center electrode inside the axial hole;

a metal shell which holds the ceramic insulator and surrounds a circumference of the ceramic insulator;

a ground electrode, one end portion of which is fixedly connected with the metal shell, and the other end portion of which curves so that one side surface of the other end portion faces a top end portion of the center electrode; and an ignition portion which is provided at a position that faces the top end portion of the center electrode on the one side surface of the other end portion of the ground electrode and protrudes from the one side surface toward the center electrode, and the ignition portion having a pedestal portion which protrudes from the one side surface toward the center electrode;

a discharge portion which is joined to a protrusion top end of the pedestal portion by laser welding and forms a spark discharge gap between the discharge portion and the top end portion of the center electrode, said discharge portion having an outside diameter of 0.7 mm or more; and a melting portion which intervenes between the pedestal portion and the discharge portion and is formed with constituent materials of both the pedestal portion and the discharge portion melting and mixed together by the laser welding, when viewing a chosen cross section of the ignition portion including a center axis of the ignition portion in a direction in which the ignition portion protrudes from the one side surface of the ground electrode, the melting portion being formed so as to extend from a side surface of the ignition portion toward the center axis, when viewing a profile line of the chosen cross section of the ignition portion, the melting portion having a configuration that connects a side surface of the pedestal portion and a side surface of the discharge portion, and in the chosen cross section of the ignition portion, X1 located in a boundary position between the pedestal portion and the melting portion at one of the side surfaces of the ignition portion, X2 located in a boundary position between the discharge portion and the melting portion at one of the side surfaces of the ignition portion, then when viewing a first cross section in which a distance of a straight line connecting the boundary positions X1 and X2 becomes a maximum in the chosen cross sections, a relationship between an outside diameter S and an extending length T satisfying $T/S \geqq 0.5$, where S is the outside diameter of the discharge portion in a radial direction orthogonal to the center axis and where T is the extending length of the melting portion in a radially inward direction, on the basis of the boundary position X2 between the discharge portion and the melting portion, and an exterior angle θ formed between an imaginary line that passes through the boundary positions X1 and X2 and the center axis satisfying $135° \leqq \theta \leqq 175°$.

2. The spark plug as claimed in claim 1, wherein:

a difference between a linear expansion coefficient of the constituent material of the discharge portion and a linear expansion coefficient of the constituent material of the pedestal portion is $8.1 \times 10^{-6}$ [1/K] or less.

3. The spark plug as claimed in claim 1, wherein:

the side surface of the pedestal portion and the one side surface of the ground electrode where the pedestal portion is provided are connected through a first connecting portion that has a concave shape curving inwards in a cross section including the center axis of the ignition portion.

4. The spark plug as claimed in claim 3, wherein:

the pedestal portion has, on one side surface of the ground electrode side, a flange portion formed by enlarging an outside diameter of the pedestal portion, and a surface, which faces the protrusion top end, of the flange portion of the pedestal portion and a side surface, which is located on a protrusion top end side with respect to the flange portion, of the pedestal portion are connected through a second connecting portion that has a concave shape curving inwards in a cross section including the center axis of the ignition portion.

5. The spark plug as claimed in claim 1, wherein:

the discharge portion of the ignition portion is made of any one noble metal of Pt, Ir, Rh and Ru, or is made of noble metal alloy containing at least one or more noble metals of these noble metals.

6. The sparkplug as claimed in claim 1, wherein:

at least more than half of all cross sections, which are chosen cross sections of the ignition portion and are observed from different circumferential direction positions of an entire circumference of the ignition portion with the center axis being a center, satisfy $T/S \geqq 0.5$ and $135° \leqq \theta \leqq 175°$.

* * * * *